US008664554B2

(12) United States Patent
Iordache

(10) Patent No.: US 8,664,554 B2
(45) Date of Patent: Mar. 4, 2014

(54) ELECTRICAL SWITCH ASSEMBLY COMPRISING A 5-WAY TOGGLE MECHANISM AND ILLUMINATED FLEXIBLE LAYER

(75) Inventor: Lucian Iordache, Woodbridge (CA)

(73) Assignee: Omron Dualtec Automotive Electronics Inc., Oakville (CA)

( * ) Notice: Subject to any disclaimer, the term of this patent is extended or adjusted under 35 U.S.C. 154(b) by 378 days.

(21) Appl. No.: 12/958,862

(22) Filed: Dec. 2, 2010

(65) Prior Publication Data

US 2011/0132735 A1 Jun. 9, 2011

Related U.S. Application Data

(60) Provisional application No. 61/266,220, filed on Dec. 3, 2009.

(51) Int. Cl.
*H01H 9/00* (2006.01)

(52) U.S. Cl.
USPC ..... 200/314

(58) Field of Classification Search
USPC ..... 200/5 A, 6 A, 17 R, 18, 406, 511–517, 200/302.1–302.3, 310–317, 341, 345; 341/20, 22; 345/156, 157, 161, 345/168–170; 455/575.1
See application file for complete search history.

(56) References Cited

U.S. PATENT DOCUMENTS

| | | | | |
|---|---|---|---|---|
| 3,584,162 | A * | 6/1971 | Krakinowski | 200/5 A |
| 4,365,120 | A * | 12/1982 | Pounds | 200/5 A |
| 4,937,932 | A * | 7/1990 | Ishii | 29/622 |
| 5,619,021 | A * | 4/1997 | Yamamoto et al. | 200/6 A |
| 6,084,189 | A * | 7/2000 | Menche et al. | 200/315 |
| 6,148,183 | A | 11/2000 | Higdon et al. | |
| 6,479,769 | B1 * | 11/2002 | Barat et al. | 200/5 R |
| 6,635,832 | B1 * | 10/2003 | Oster et al. | 200/6 A |
| 6,694,236 | B2 * | 2/2004 | Onodera | 701/36 |
| 6,868,259 | B1 * | 3/2005 | Kitamura et al. | 455/90.3 |
| 6,900,402 | B2 * | 5/2005 | Lam et al. | 200/314 |
| 7,038,152 | B2 * | 5/2006 | Watanabe | 200/314 |
| 7,485,824 | B2 * | 2/2009 | Rastemborski et al. | 200/516 |
| 2005/0115815 | A1 | 6/2005 | Endres et al. | |
| 2009/0229961 | A1 | 9/2009 | Larsen et al. | |
| 2010/0084252 | A1 | 4/2010 | Ragagopal et al. | |

OTHER PUBLICATIONS

Hijazi, Mazen; International Search Report from corresponding PCT Application No. PCT/CA2010/001908; search completed Apr. 27, 2011.

* cited by examiner

*Primary Examiner* — Edwin A. Leon
(74) *Attorney, Agent, or Firm* — Brett J. Slaney; John R. S. Orange; Blake, Cassels & Graydon LLP

(57) ABSTRACT

A switch assembly is provided that in one aspect provides a switch knob that can move in up to five directions by using a plunger element that moves with respect to an actuation plate such that tilting the knob in any of four directions uses the plate to activate underlying domes whereas pressing the knob towards the assembly provides a fifth function by moving the plunger element with respect to the plate and thus activating a central dome beneath the plunger element. In another aspect, the switch assembly enables a larger area of illumination on an illuminated film by interposing a light pipe between an actuation dome and the film, the light pipe also serving as a plunger element to enable touch actuation by pressing the film, moving the plunger towards the dome and activating the dome.

17 Claims, 10 Drawing Sheets

ELECTRICAL SWITCH ASSEMBLY COMPRISING A 5-WAY TOGGLE MECHANISM AND ILLUMINATED FLEXIBLE LAYER

This application claims priority from U.S. Provisional Application No. 61/266,220 filed on Dec. 3, 2009, the entire contents of which are incorporated herein by reference.

TECHNICAL FIELD

The following relates generally to electrical switches, and has particular utility in automotive switch assemblies.

BACKGROUND

Electrical switch assemblies utilize various principles in order to provide suitable functionality for a given application and often to provide a specific "feel" to the switch. For example, in electronic appliances such as microwave ovens, illuminated films are sometimes used for push actuation of a button, e.g. on a keypad. In such switches, as shown in FIG. 14, a printed circuit board A underlies a layer of film B. The PCB A comprises a light emitting diode (LED) C, which illuminates the film B by directing light through a dome D, often a metal dome D with an aperture at the top. Given the geometry shown in FIG. 14, it can be seen that the area of illumination E is limited by the size of the aperture in the dome. Since the area of illumination E is typically required to reveal a graphical element on the layer of film B, limitations on the area of illumination E correspondingly limit the size of the graphic and thus the potential applications of such a switch type.

In other electrical switch assemblies, multi-directional actuator buttons or knobs are often used to provide multiple functions together in the same assembly. For example, in automotive applications, seat adjustments, mirror adjustments and entertainment systems, just to name a few, typically utilize multi-functional knobs. However, such switch knobs are typically limited in their movements and it is desirable to maximize the number of functions that can be provided by the same switch assembly, especially given the number of features that require electrical activation.

SUMMARY

In one aspect, there is provided an electrical switch assembly comprising: a circuit layer comprising at least one light source; at least one collapsible dome supported on said circuit layer above said at least one light source, said collapsible dome comprising an aperture for permitting passage of light therethrough; a plunger element aligned with said dome, said plunger element configured to permit said light passing through said dome to pass therethrough; and a film layer supported over said plunger element such that said plunger element bears against said film layer at rest, wherein deflection of said film layer in the vicinity of said plunger element moves said plunger element towards said dome to activate same.

In another aspect, there is provided an electrical switch assembly comprising: an elastomeric layer overlying a circuit layer, said elastomeric layer comprising a central elastomeric dome and at least one surrounding collapsible dome; an actuation plate comprising a central collar with a passage, said actuation plate being sized to engage said at least one surrounding collapsible dome; a plunger element comprising a post extending through said collar to permit movement of said plunger element relative to said actuation plate, and a flange to engage the underside of the actuation plate when moved in one direction and to engage said central dome when moved in another direction; and an actuation knob connected to a free end of said post, wherein movement of the knob in one or more directions orthogonal to an axis defined by said post at rest actuates said at least one surrounding dome and movement of the knob along said axis and towards the actuation plate moves the plunger element relative to the actuation plate to actuate the central dome.

BRIEF DESCRIPTION OF THE DRAWINGS

Embodiments will now be described by way of example only with reference to the appended drawings wherein.

DETAILED DESCRIPTION OF THE DRAWINGS

It will be appreciated that although the following examples are provided in the context of automobile switches, the principles discussed herein are equally applicable to any electrical switch assembly.

Figure 1:
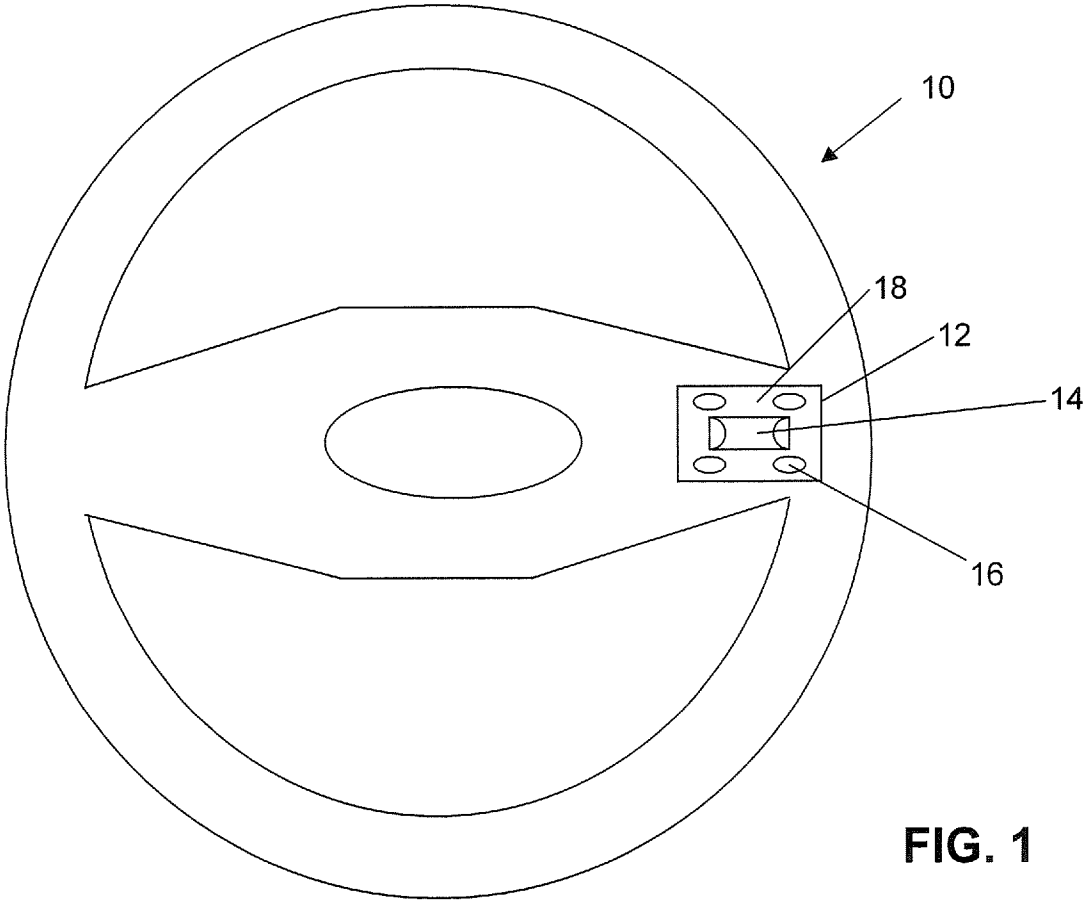
FIG. 1 is a pictorial illustration of an automotive steering wheel comprising a switch assembly.

Turning now to FIG. 1, an automotive steering wheel 10 is shown, which comprises thereon, a switch assembly 12. The switch assembly 12 comprises an actuator knob 14 that, as will be explained below, provides 5-way functionality, namely by tilting the knob 14 up or down, pressing the knob 14 at either end, or pressing the knob 14 at substantially the center thereof. The switch assembly 12 also comprises a series of graphical elements 16 integrated into an exposed flexible layer 18 that provides a touch-actuation functionality as will be explained in greater detail below. The graphical elements 16 are translucent or transparent portions of the flexible layer 18 to thus permit light to pass through the flexible layer 18 providing illuminated shapes that correspond to features of the switch assembly 12. The flexible layer 18 is made from a flexible material to provide the touch-actuation functionality such that touching the graphical elements 16 compresses or flexes the flexible layer 18 to actuate an underlying switch sub-assembly.

Figure 2:
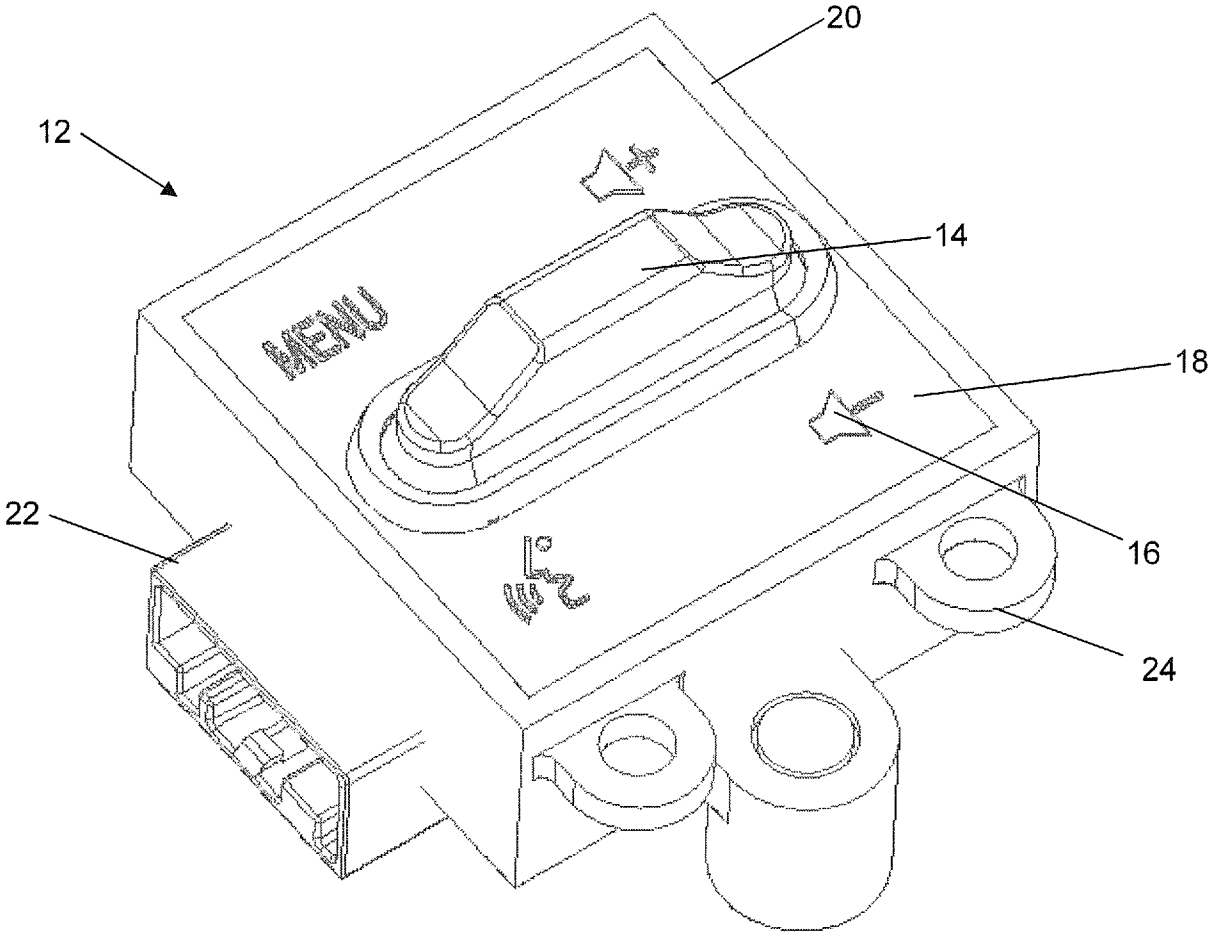
FIG. 2 is a perspective view of the switch assembly of FIG. 1 in isolation.

FIG. 2 provides a perspective view of the switch assembly 12 in isolation. The switch assembly 12 comprises a housing 20 that supports the flexible layer 18 and the knob 14, in this example such that they are exposed on the steering wheel 10. The housing 20 comprises or otherwise supports a connector 22 for connecting the switch assembly 12 to the electrical system of a vehicle (not shown) and a series of mounting brackets 24 for securing the switch assembly 12 to the steering wheel 10.

Figure 3:
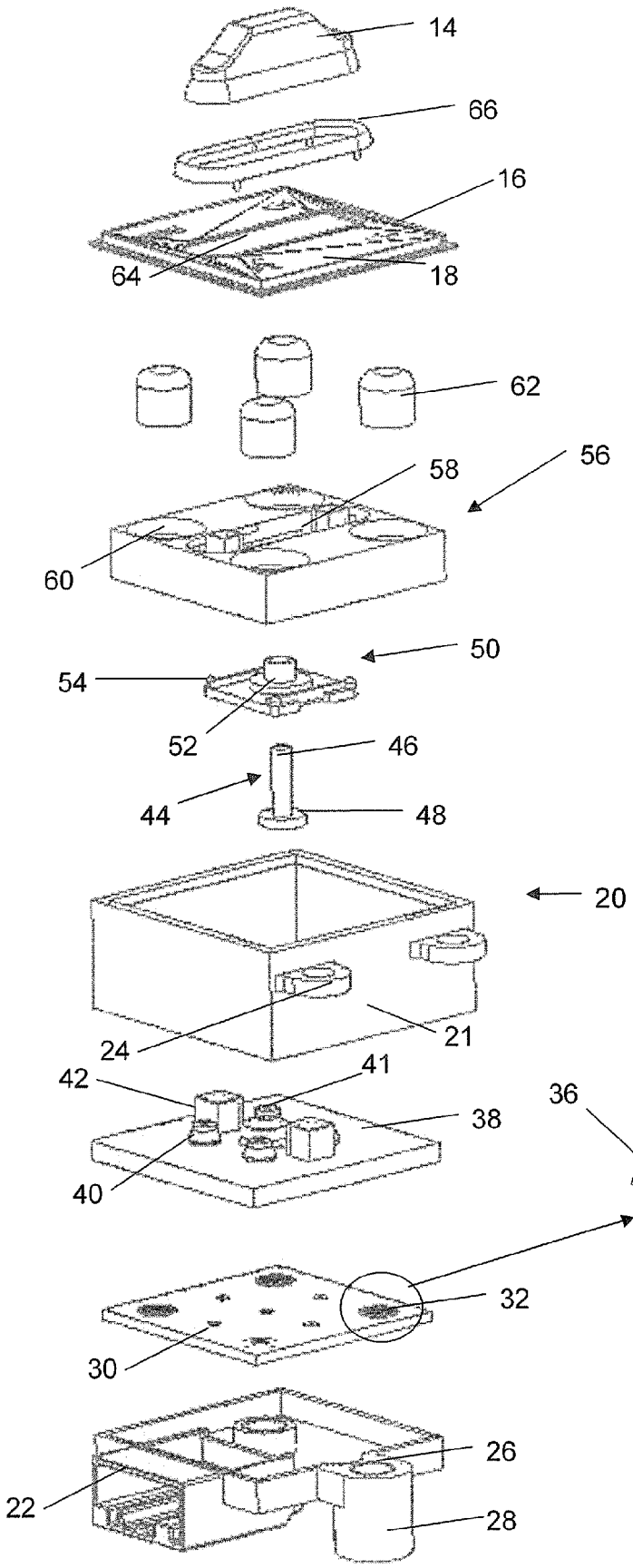
FIG. 3 is an exploded perspective view of the switch assembly of FIG. 2.
Figure 4:
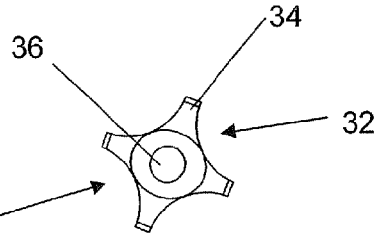
FIG. 4 is an enlarged plan view of one of the metal domes shown in FIG. 3.

FIG. 3 provides an exploded perspective view of the switch assembly 12. Beginning at the base area, the housing 20 comprises a lower base portion 26, which comprises brass inserts 28 for stiffening the assembly 12. The base portion 26 supports a printed circuit board (PCB) 30. The PBC 30 supports a metal dome 32 at each corner. A metal dome 32 is shown in greater detail in FIG. 4. It can be seen from FIG. 4 that the metal dome 32 comprises a set of four feet 36 surrounding a central aperture 36. Turning back to FIG. 3, the PCB 30 also supports an elastomeric layer (e-layer) 38, which comprises a series of domes 40 in a central portion of the e-layer 38 that are aligned with an actuation plate 50 that is operated by the knob 14 in the four tilt operations as discussed below. The series of domes 40 surround a central dome 41 that is operated on by the knob 14 in a push or press operation. The e-layer 38 also comprises a pair of elastomeric posts 42, which are used to guide light towards the film layer 18.

The housing 20 also comprises a square-shaped collar 21 that supports the mounting brackets 24 and protects the components of the switch assembly 12 that are housed between the flexible layer 18 and the base 26. The central dome 41 supports a plunger 44, which is operated by the knob 14 to collapse the central dome 41. The plunger 44 comprises a rigid cylindrical post 46 extending from a flange 48 that defines a base portion of the plunger 44. The post 46 extends through the actuation plate 50 to thereby translate movement of the actuation plate 50 to the underlying central dome 41 when the post 46 moves axially. The actuation plate 50 comprises a central collar 52 to guide the plunger 44 in an axial direction and inhibit radial movements or other translations in the plane defined by the base 26 and flexible layer 18. The actuation plate 50 also comprises a foot 54 at each corner which is aligned with a corresponding one of the domes 40 such that a tilting movement of the actuation plate 50 towards a dome 40 will collapse that dome 40.

An interior support 56 is sized to fit within the square collar portion 21 of the housing 20 and provides physical separation between the flexible layer 18, supported thereon, and the e-layer 38. The interior support 56 comprises a central slot 58 which in this example is rounded at each end and is configured according to the shape and size of the knob 14. The slot 58 permits the post 46 to extend to and engage the knob 14 and thus enables the knob 14 to operate on the actuation plate 50 via the plunger 44. The support 56 also comprises a set of four cylindrical passages or apertures 60, which retain and guide movement of corresponding clear plungers 62 that operate on the metal domes 32 upon compression or deflection of the flexible layer 18 and thus are each aligned with a corresponding graphical element 16. The clear plungers 62 also permit light emitted by underlying LEDs 68 (see FIG. 6) to pass through the flexible layer 18 and illuminate the graphical elements 16 to identify the portion of the flexible layer 18 that can be compressed or deflected to activate a feature represented by the graphical element 16.

As can also be seen in FIG. 3, the flexible layer 18 also comprises a slot 64 which corresponds approximately to the size of the slot 58 in the interior support 56. An annular ring 66 surrounds the knob to provide both aesthetic appeal (e.g. may be made from chrome) and to inhibit contaminates from entering the switch assembly 12 between the knob 14 and the flexible layer 18.

Figure 5:
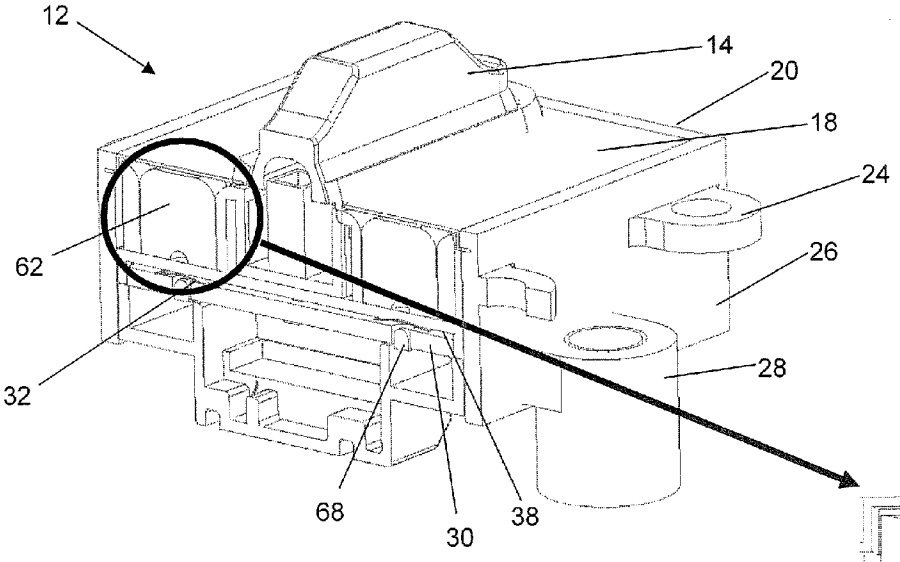
FIG. 5 is a cross-sectional perspective view of the switch assembly of FIG. 2.
Figure 6:
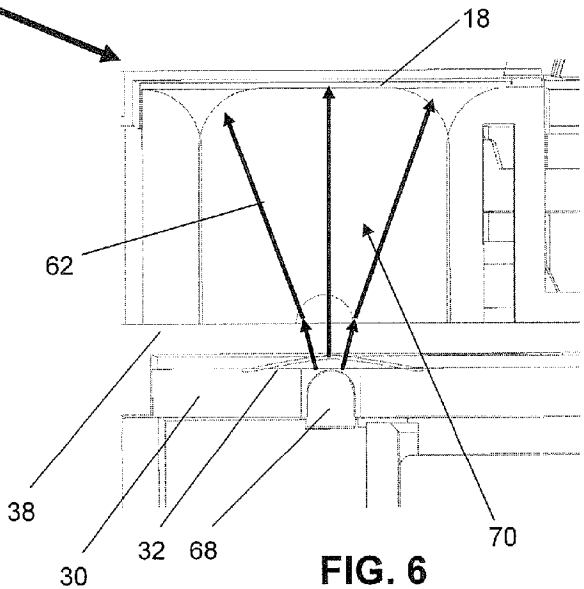
FIG. 6 is an enlarged profile view of a portion of the cross section shown in FIG. 5.
Figure 15:
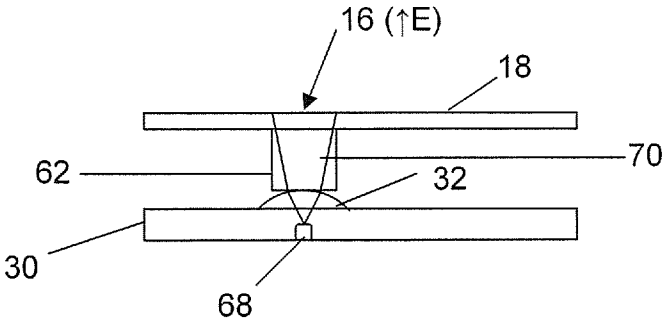
FIG. 15 is a cross-sectional elevation view of the switch assembly shown in FIG. 6.
Figure 14:
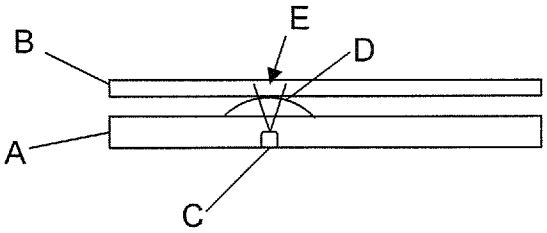
Prior Art FIG. 14
FIG. 14 is a cross-sectional elevation view of a prior art switch assembly utilizing an illuminated film.
Figure 16:
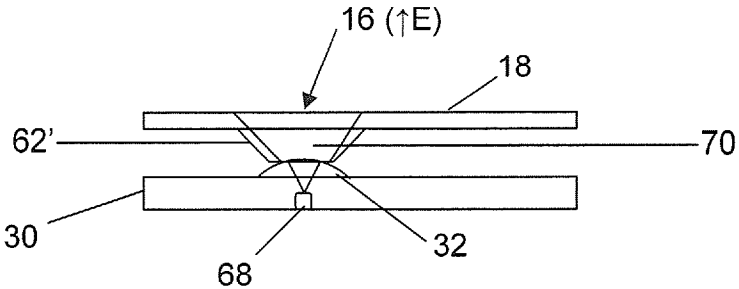
FIG. 16 is a cross-sectional elevation view of another embodiment of the plunger for the switch assembly shown in FIG. 6.

FIGS. 5 and 6 illustrate further detail of a first switch sub-assembly for illuminating the graphical elements 16 and permitting actuation of a feature through compression of the flexible layer 18. As best seen in FIG. 6, the PCB 30 embeds or otherwise accommodates an LED 68 that is used to illuminate a corresponding graphical element 16 in the flexible layer 18. The PCB 30 supports a metal dome 32, which is positioned such that the aperture 36 is aligned with the LED 68 to permit the passage of light being emitted by the LED 68. The e-layer 38 covers the PCB 30 and thus should include corresponding apertures (not shown) or provide enough transparency to permit the light passing through the apertures 36 to be collected in the clear plunger 62. The clear plunger 62 can be made from any suitable material such as a plastic that possesses some transparent or translucent properties. As best illustrated in FIG. 15, when compared to the prior art configurations (e.g. as shown in FIG. 14) by interposing a light pipe, in this example doubling as a plunger 62 for actuating the metal dome 32, the light 70 that collects at the top of the dome 32 and passes through its aperture 36 can spread according to the shape of the plunger 62 and thus increase the size of the illuminated area E (denoted by ↑E in FIG. 15) and thus enable a larger graphical element 16 to be used. It can be appreciated that although the separation of the film 18 and the PCB 30 as seen in FIG. 15 using a tubular (e.g. cylindrical) plunger 62 provides a higher profile when compared to the configuration shown in FIG. 14, other embodiments such as that shown in FIG. 16 can be used to reduce the profile, namely by changing the shape of the plunger 62' and thus spreading the light using a shorter "light pipe", e.g. using a configuration having a conical or trapezoidal cross-section as shown. Also, although not clearly seen in the figures, the upper surface of the plunger 62, 62' can be textured to spread the light evenly over the graphical element 16.

The clear plunger 62 is supported by the interior support 56 between the flexible layer 18 and the e-layer 38 and the e-layer 38 rests atop the metal dome 32 such that compression of the flexible layer 18 at the location overlying the clear plunger 62 causes the clear plunger 62 to compress the e-layer 38 and actuate or "snap" the metal dome 32. Therefore, the first switch sub-assembly not only collects and directs a larger swath of light towards the graphical element 16 in the flexible layer 18, it provides a second function, namely the actuation of a switch that corresponds to the graphical element 16. In this way, the flexible layer 18 can provide both aesthetic illuminated graphics as well as touch actuation without one function interfering with the other. In other words, the clear plunger 62 acts as both a actuator and a light-pipe.

The use of a metal dome 32 is particularly advantageous due to the distinct tactile feel that is provided while providing a short travel and thus low profile. It will be appreciated that where space permits, other dome types can be used.

Figure 7:
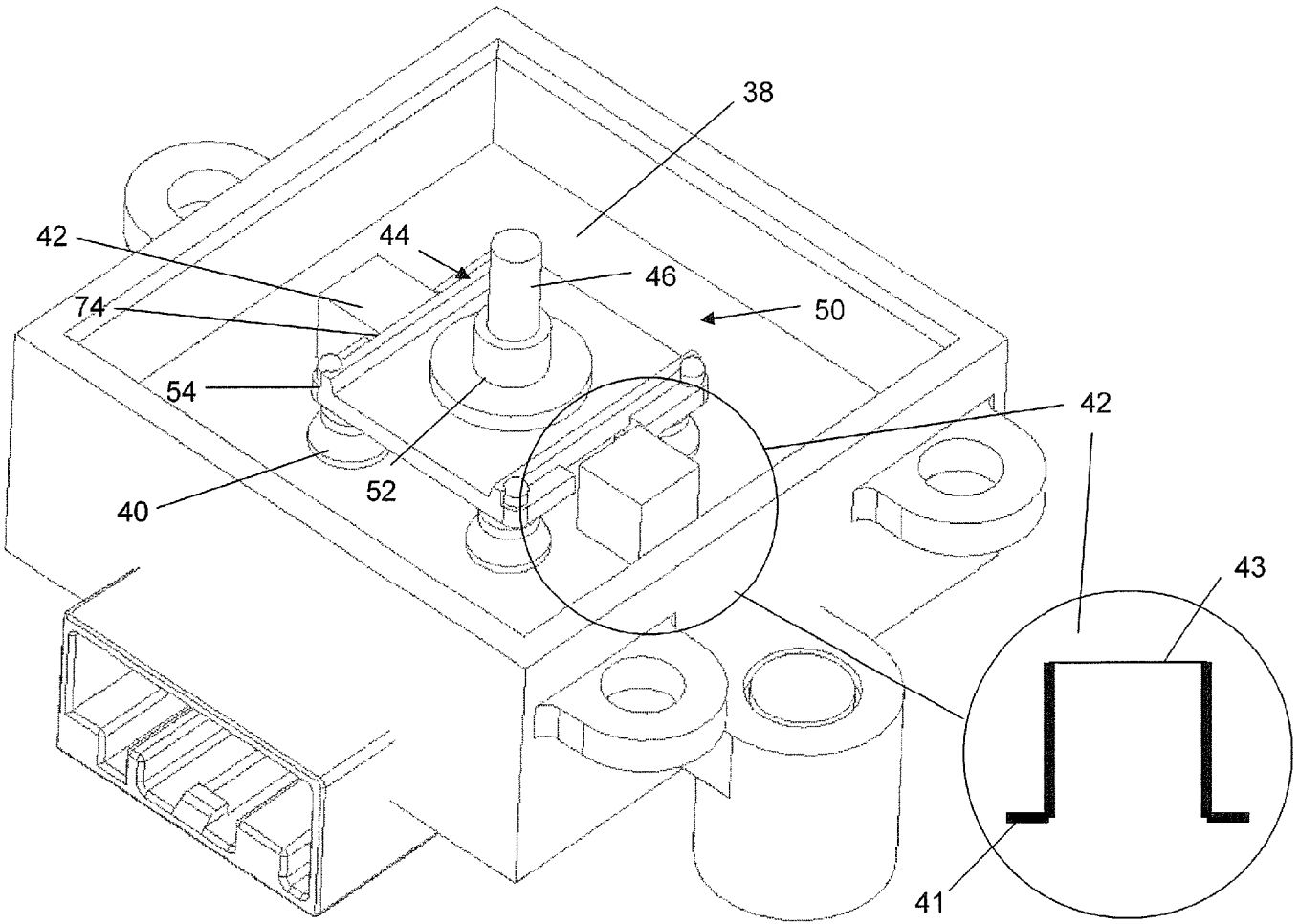
FIG. 7 is a enlarged perspective view of the actuation plate and plunger element shown in FIG. 3 with a cross sectional view of an elastomeric post.

Turning now to FIG. 7, an enlarged view of the actuation plate 50 and rigid plunger 44 is provided. It can be seen that through the interaction of the rigid post 46 and the collar 52, radial movements or longitudinal tilting will cause corresponding movements in the actuation plate 50, whereas axial movement of the post 46 causes the plunger 44 to move relative to the actuation plate 50 and thereby move the flange 48 towards the central dome 41. As also seen in FIG. 7, the actuation plate 50 comprises a pair of slots 74 to permit movement of the actuation plate 50 with respect to the elastomeric posts 42. The plunger 44 and actuation plate 50 work in conjunction with the knob 14 to provide a second switch sub-assembly. FIG. 7 also illustrates the cross-sectional profile of the elastomeric towers 42. It can be seen that the thickness of the base interface with the e-pad 38 and the upstanding side walls 41 are of the same thickness, however, the upper surface 43 may be made thinner to permit the passage of light regardless of the colour of the e-pad 38 and without requiring an aperture or other physical void or passage.

Figure 9:
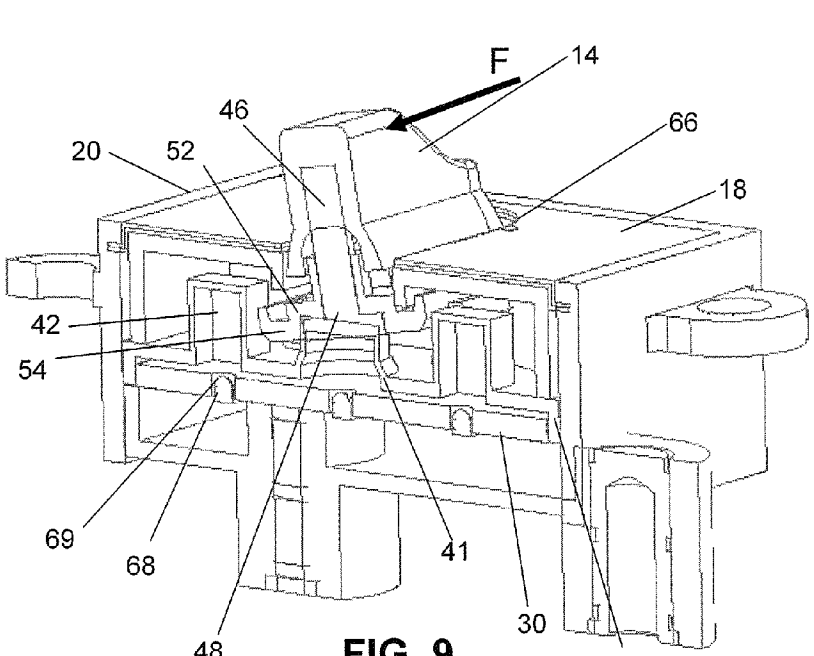
FIG. 9 is a partial cross-sectional perspective view of the assembly shown in FIG. 5 with the switch button tilted in one direction.
Figure 8:
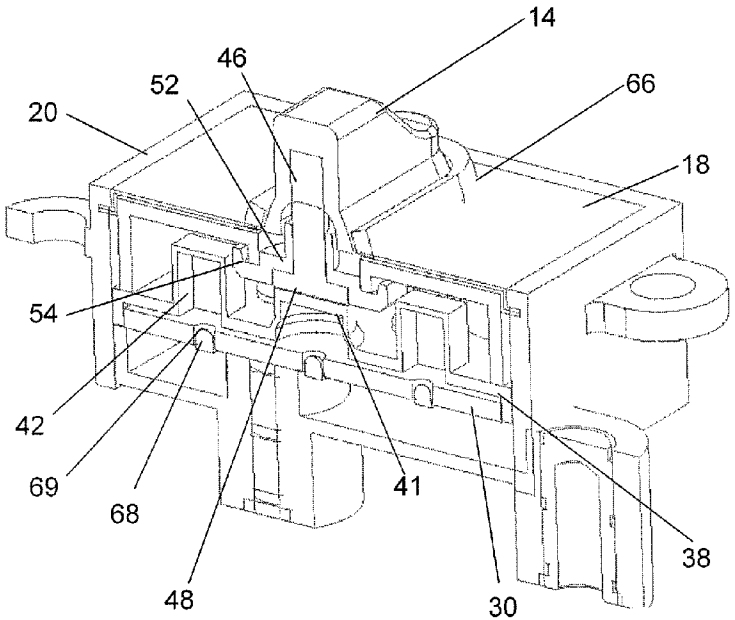
FIG. 8 is a partial cross-sectional perspective view of the assembly shown in FIG. 5 with the switch button at rest.
Figure 10:
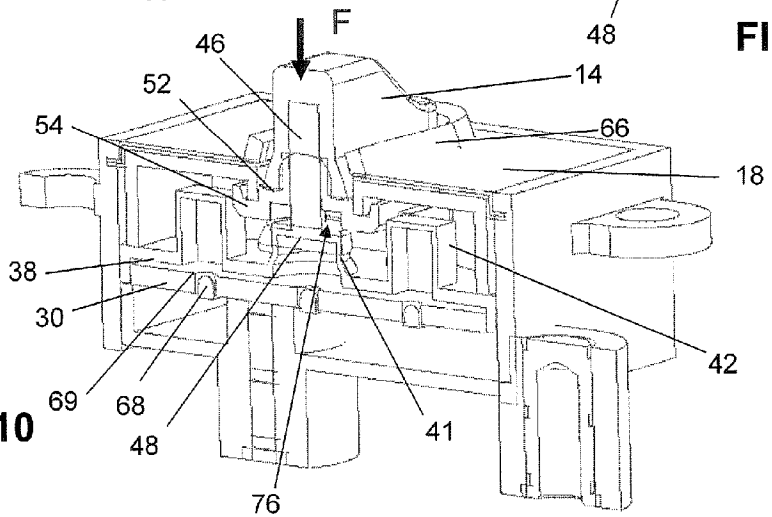
FIG. 10 is a partial cross-sectional perspective view of the assembly shown in FIG. 5 with the switch button being pushed towards the housing.

Operation of second switch sub-assembly is illustrated in FIGS. 8 to 10. FIG. 8 illustrates a rest position, wherein the actuation plate 50 is preloaded by the underlying domes 40 and the post 46 is secured in the underside of the knob 14 such that movement of the knob 14 translates to movement of the plunger 44 and actuation plate 50. A tilt operation is shown in FIG. 9 and it can be seen that the knob 14 cause the plunger 44 to tilt correspondingly which in turn causes the actuation plate 50 to actuated a pair of domes 40 through relative vertical movement of a corresponding pair of feet 54. It can be appreciated that tilt movements in the other three directions cause similar effects on different pairs of underlying domes 40. It can also be appreciated that tilt movements of the knob 14 do not move the plunger 44 axially and thus the central dome 41 remains un-actuated. However, as shown in FIG. 10, by pressing the knob 14 towards the flexible layer 18, the actuation plate 50 remains at rest while the plunger 44 moves vertically in a downward direction, moving through the collar 52 to actuate the underlying central dome 41, with a separation achieved as denoted by numeral 76 in FIG. 10. Therefore, the interaction of the plunger 44 and the actuation plate 50 enable 5-way movement of the knob 14 and five corresponding switch functions. FIGS. 8 to 10 also illustrate that the e-layer 38 can be sized to cover and wrap around the PCB 30 to provide protection against contaminates such as from accidental spillage. Drain holes can also be provided around the switches.

Figure 11:
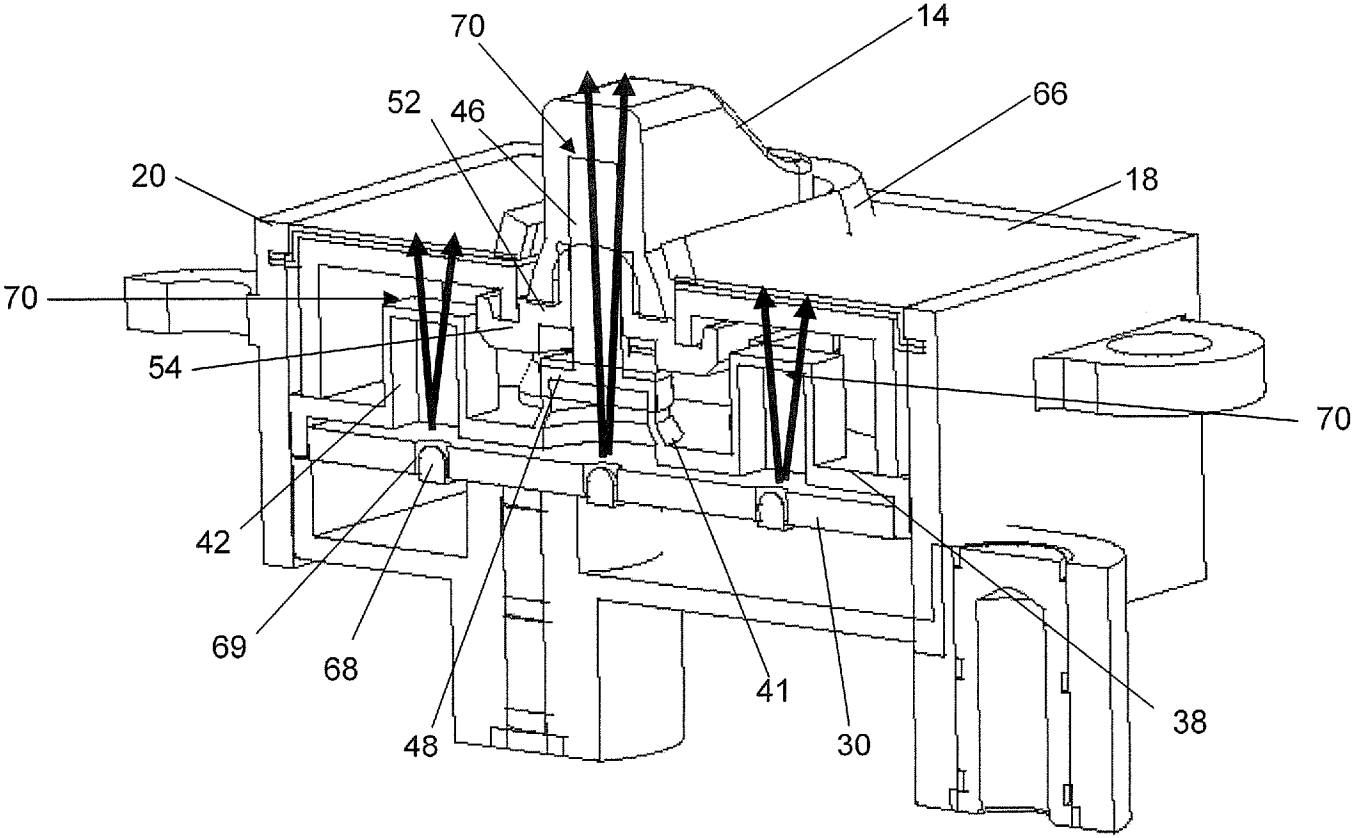
FIG. 11 is an enlarged partial cross-sectional perspective view of the assembly shown in FIG. 8 illustrating schematically the passage of light through the assembly.
Figure 12:
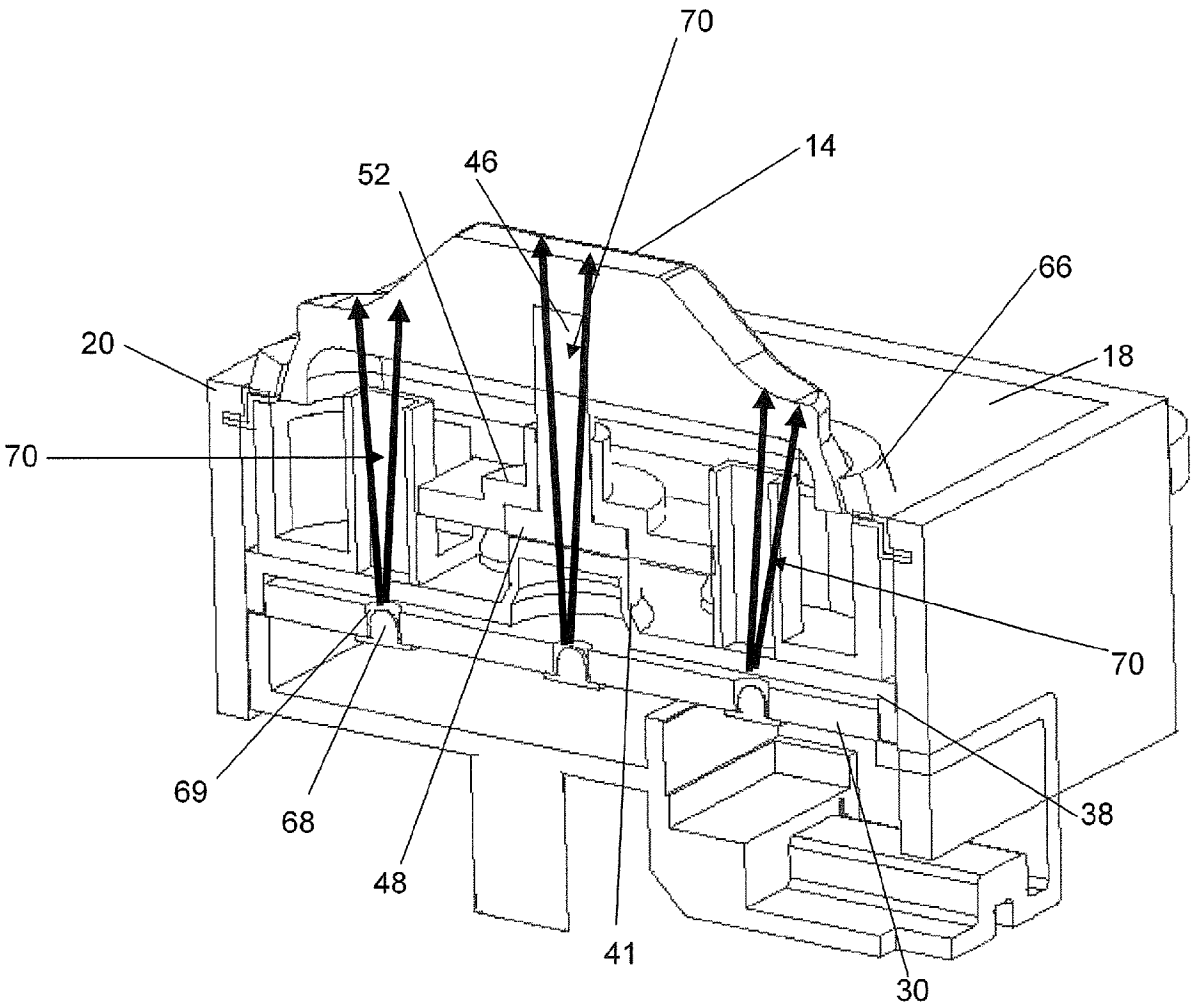
FIG. 12 is another cross-sectional perspective view of the assembly shown in FIG. 2.

FIG. 11 illustrates that the central dome 41 and elastomeric posts 42 can either provide apertures or be of a transparent or translucent material to enable light to be piped to the flexible layer 18 (or other surface surrounding the knob 14) and the knob 14 itself. Light that is directed towards the knob 14 can be used to illuminate graphics thereon (not shown) that instruct how to operate the knob 14 (e.g. up, down, push, etc.). FIG. 12 illustrates that the interior support 56 can also be configured to provide additional light pipes 70 that channel light towards end portions of the knob 14. As seen in FIG. 12, corresponding LEDs 68 can be embedded in depressions 69 in the PCB 30 where necessary. FIGS. 11 and 12 also illustrate that the knob 14 can be designed to provide overlap with the interior support 21 to protect against light leakage.

Figure 13:
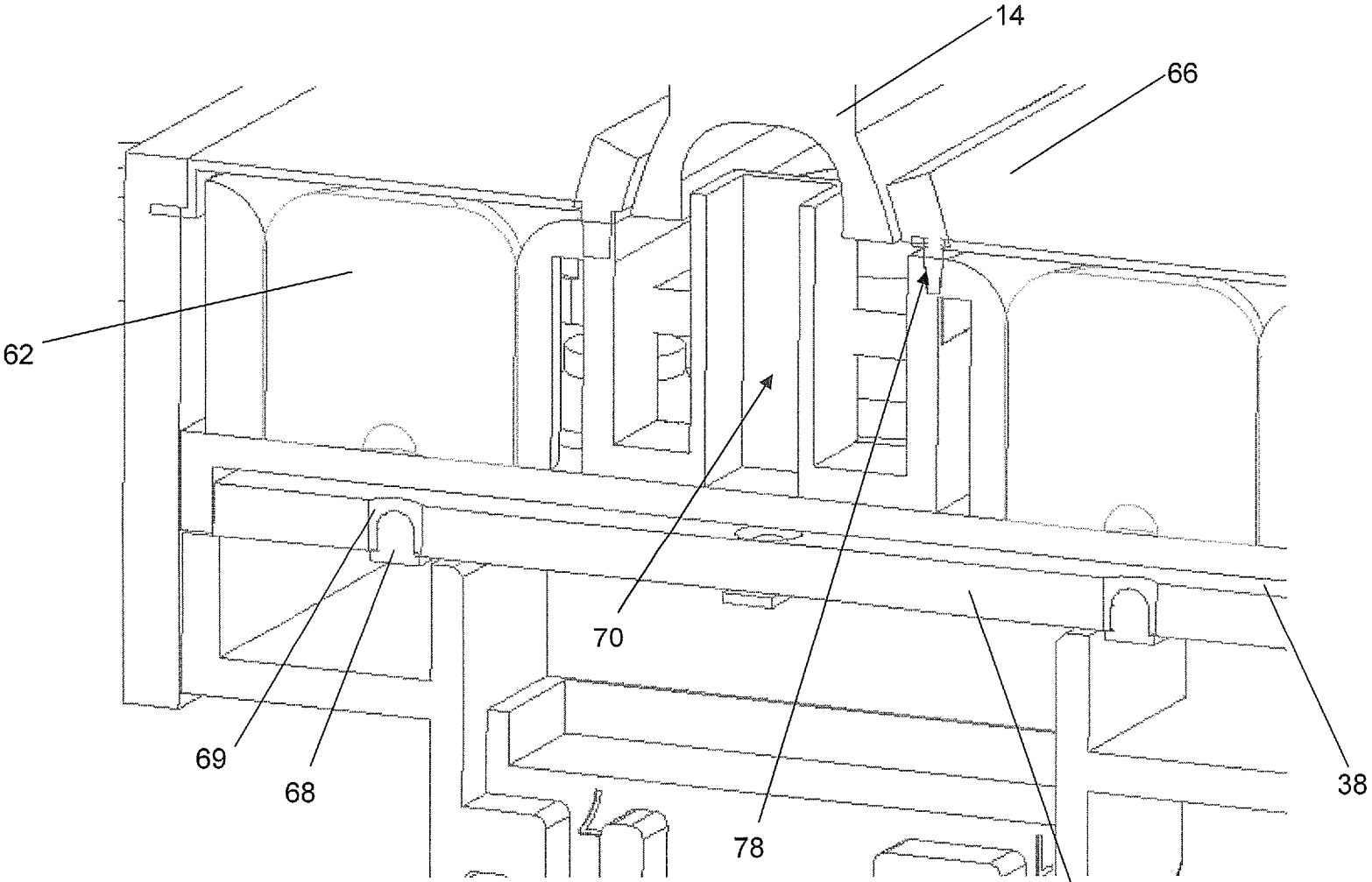
FIG. 13 is yet another cross-sectional perspective view of the assembly shown in FIG. 2.

FIG. 13 illustrates further detail of the fitment of the annular ring 66 into the interior support 21. A portion 78 of the ring 66 in this example is snapped into the support 21 trapping the flexible layer 18 with respect to the housing 20. The inside profile of the ring 66 and the outside profile of the knob 14 can be provided with complimentary curvatures defined according to the centre point of rotation of the knob 14 to maintain a constant gap.

Although the above has been described with reference to certain specific embodiments, various modifications thereof will be apparent to those skilled in the art without departing from the scope of the claims appended hereto.

The invention claimed is:

1. An electrical switch assembly comprising:

a circuit layer comprising at least one light source;

at least one collapsible dome supported on said circuit layer above said at least one light source, said collapsible dome comprising an aperture spaced from said at least one light source for permitting passage of light from the light source therethrough;

a plunger element aligned with said dome over said aperture and comprising an opening at a lower end thereof to permit said light to enter said plunger, said plunger element sized to permit said light passing through said dome to spread therewithin towards an upper surface thereof and to pass through said upper surface; and a film layer supported over said plunger element such that said plunger element bears against said film layer at rest, wherein deflection of said film layer in the vicinity of said plunger element moves said plunger element towards said dome to activate same.

2. The switch assembly of claim 1, wherein said plunger element is composed of a transparent or translucent material for permitting said passage of said light therethrough.

3. The switch assembly of claim 1, wherein said plunger element provides a particular separation between said aperture and said film layer to allow said light to spread within said plunger element to thereby increase an area of illumination on said film layer.

4. The switch assembly of claim 3, wherein said plunger element comprises a tubular shape.

5. The switch assembly of claim 3, wherein said plunger element comprises a conical or trapezoidal cross-section.

6. The switch assembly of claim 1, wherein said film layer comprises a graphical element in said vicinity of said plunger.

7. The switch assembly of claim 1, wherein said collapsible dome is a metal dome.

8. The switch assembly of claim 1, wherein said at least one light source comprises a light emitting diode (LED).

9. An electrical switch assembly comprising:

an elastomeric layer overlying a circuit layer, said elastomeric layer comprising a central elastomeric dome, at least one surrounding collapsible dome, and at least one elastomeric post comprising an upper surface that permits passage of light therethrough, said circuit layer comprising a light source aligned with each said at least one elastomeric post;

an actuation plate comprising a central collar with a passage, said actuation plate being sized to engage said at least one surrounding collapsible dome, said actuation plate configured to accommodate said at least one elastomeric post;

a plunger element comprising a post extending through said collar to permit movement of said plunger element relative to said actuation plate, and a flange to engage the underside of the actuation plate when moved in one direction and to engage said central dome when moved in another direction;

an actuation knob connected to a free end of said post, wherein movement of the knob in one or more directions orthogonal to an axis defined by said post at rest actuates said at least one surrounding dome and movement of the knob along said axis and towards the actuation plate moves the plunger element relative to the actuation plate to actuate the central dome; and a surface surrounding said actuation knob, said surface comprising a transparent or translucent area aligned with said elastomeric post to enable said area to be illuminated by said light source.

10. The switch assembly according to claim 9, wherein said actuation plate extends outwardly from said central collar such that a portion thereof overlies each of said at least one surrounding collapsible dome.

11. The switch assembly according to claim 9, wherein said actuation knob permits movement along four orthogonal directions for actuating said at least one surrounding dome.

12. The switch assembly according to claim 9, wherein said central elastomeric dome comprises a transparent or translucent material to permit passage of light therethrough, wherein said plunger element permits said light to pass therethrough, said switch assembly further comprising said circuit layer, said circuit layer comprising a light source aligned with said central elastomeric dome, and said actuation knob comprising a transparent or translucent area aligned with said central elastomeric dome to enable said area to be illuminated by said light source.

13. The switch assembly of claim 12, wherein said at least one light source comprises a light emitting diode (LED).

14. The switch assembly of claim 9, wherein said at least one light source comprises a light emitting diode (LED).

15. The switch assembly of claim 9, further comprising:

a circuit layer comprising at least one light source;

at least one additional collapsible dome supported on said circuit layer above said at least one light source, said additional collapsible dome comprising an aperture for permitting passage of light therethrough;

an additional plunger element aligned with said additional collapsible dome, said additional plunger element configured to permit said light passing through said additional collapsible dome to pass therethrough; and a film layer supported over said additional plunger element such that said additional plunger element bears against said film layer at rest, wherein deflection of said film layer in the vicinity of said additional plunger element moves said plunger element towards said additional collapsible dome to activate same.

16. The switch assembly of claim 15, wherein said plunger element is composed of a transparent or translucent material for permitting said passage of said light therethrough.

17. The switch assembly of claim 15, wherein said plunger element provides a particular separation between said aperture and said film layer to allow said light to spread within said plunger element to thereby increase an area of illumination on said film layer.

* * * * *